US010506357B2

(12) United States Patent
Hanzlik et al.

(10) Patent No.: US 10,506,357 B2
(45) Date of Patent: Dec. 10, 2019

(54) ELECTRIC CIRCUITRY TO REGULATE A BIAS VOLTAGE FOR A MICROPHONE

(71) Applicant: TDK Corporation, Tokyo (JP)

(72) Inventors: Tomasz Hanzlik, Szczecin (PL); Gino Rocca, Copenhagen (DK); Marco De Blasi, Gentofte (DK); Henning Petersen, Allerod (DK)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/202,555

(22) Filed: Nov. 28, 2018

(65) Prior Publication Data

US 2019/0166443 A1 May 30, 2019

(30) Foreign Application Priority Data

Nov. 29, 2017 (DE) ..... 10 2017 128 259

(51) Int. Cl.
*H04R 29/00* (2006.01)
*H04R 3/00* (2006.01)
*H04R 3/06* (2006.01)

(52) U.S. Cl.
CPC ..... *H04R 29/004* (2013.01); *H04R 3/00* (2013.01)

(58) Field of Classification Search
CPC ..... H04R 29/004; H04R 3/00
See application file for complete search history.

(56) References Cited

U.S. PATENT DOCUMENTS

2015/0163594 A1 6/2015 Anderson
2017/0150253 A1* 5/2017 Ravnkilde ..... H04R 3/007

FOREIGN PATENT DOCUMENTS

WO 2015176745 A1 11/2015

* cited by examiner

*Primary Examiner* — Ping Lee
(74) *Attorney, Agent, or Firm* — Slater Matsil, LLP

(57) ABSTRACT

An electric circuit for regulating a bias voltage for a transducer of a microphone, the electric circuit including a bias voltage generator configured to generate the bias voltage for the transducer of the microphone and including a sound pressure detector configured to detect the sound pressure which impacts the transducer of the microphone. The bias voltage generator is configured to generate the bias voltage with a linear increasing gradient or linear decreasing gradient in response to the sound pressure detected by the sound pressure detector exceeding or falling below at least one threshold value of the sound pressure.

11 Claims, 6 Drawing Sheets

ELECTRIC CIRCUITRY TO REGULATE A BIAS VOLTAGE FOR A MICROPHONE

CROSS-REFERENCE TO RELATED APPLICATIONS

This application claims the benefit of German patent application 10 2017 128 259.9, filed on Nov. 29, 2017, which application is hereby incorporated herein by reference.

TECHNICAL FIELD

The disclosure relates to an electric circuitry to regulate a bias voltage for a microphone, in particular a MEMS microphone.

BACKGROUND

A microphone, for example, a MEMS microphone, comprises a capacitive transducer that can be modelled as a variable capacitor having a variable capacitance being dependent on a sound pressure that impacts on a membrane of the variable capacitor. The transducer may comprise a diaphragm and a backplate. By an acoustical input, in particular a pressure wave, the diaphragm may be deflected such that the distance between the diaphragm and the backplate changes, resulting in a change of the capacitance of the transducer. When the transducer is subjected to very high sound pressure levels (SPL), the diaphragm may contact the backplate so that an acoustical collapse of the diaphragm may occur.

In order to operate the microphone, a bias voltage is usually applied to the transducer, in particular between the diaphragm and the backplate of the transducer. By adjusting the value of the bias voltage, the sensitivity of the transducer may be adjusted. To increase the dynamic range of the MEMS microphone, its bias voltage can be reduced before the sound pressure level gets so high that an acoustical collapse would take place.

The transducer is usually coupled to a preamplifier that generates an amplified output signal in dependence on the sound pressure that impacts on the membrane of the transducer. A reduction of the bias voltage in order to prevent an acoustical collapse can, however, cause the preamplifier DC input voltage to move away from its biasing operation point and potentially bring it to saturation, which will turn into a lack of sensitivity and/or distortion.

SUMMARY

There is a desire to provide an electric circuitry to regulate the bias voltage for a transducer of a microphone to minimize glitches in the microphone.

An embodiment of an electric circuitry to regulate a bias voltage for a transducer of a microphone is described herein.

The electric circuitry comprises a bias voltage generator to generate the bias voltage for the transducer of the microphone, and a sound pressure detector to detect the sound pressure which impacts to the transducer of the microphone. The bias voltage generator is configured to generate the bias voltage with a linear increasing or decreasing gradient, if the sound pressure detected by the sound pressure detector exceeds or falls below at least one threshold value of the sound pressure.

In particular, the bias voltage generator is configured to generate the bias voltage with a linear increasing gradient, if the sound pressure detected by the sound pressure detector exceeds the at least one threshold value. Furthermore, the bias voltage generator is configured to generate the bias voltage with a linear decreasing gradient, if the sound pressure detected by the sound pressure detector falls below the at least one threshold value.

In order to generate the linear increasing or decreasing gradient of the bias voltage, the bias voltage generator comprises a first generator unit to generate a first bias voltage portion and a second generator unit to generate a second bias voltage portion. The value of the bias voltage is generated in dependence on the first and second bias voltage portions. According to a possible embodiment of the electric circuitry, the bias voltage can be generated by an addition of the first bias voltage portion and the second bias voltage portion.

The first generator unit may comprise a plurality of charge pump stages which can be activated/enabled or deactivated/disabled. The first generator unit is configured such that, if the sound pressure exceeds one of the threshold values, one of the charge pump stages is deactivated/ disabled so that the first bias voltage portion is reduced by a predefined level/predefined voltage jump. As a consequence, the first bias voltage portion is reduced stepwise. At the same time, whenever one of the charge pump stages is deactivated/disabled, the second bias voltage portion generated by the second generator unit is increased by one charge pump stage voltage, and then decreased to its original value. The gradient of the linear decreasing of the second bias voltage portion depends on the voltage jump and the time during which the sound pressure rises between subsequent threshold values.

On the other hand, if it is detected that the sound pressure falls below one of the threshold values, one of the charge pump stages of the first generator unit is activated/enabled so that the first bias voltage portion is increased by a predefined voltage level/voltage jump generated by one charge pump stage. At the same time, when the first bias voltage portion is increased by the predefined voltage level, the second bias voltage portion is decreased by the second generator unit by the predefined voltage level/voltage jump of one charge pump stage. The second bias voltage portion is then increased again to its original value. The derivative of the gradient of the second bias voltage portion depends on the voltage jump and the time during which the sound pressure level is decreased between subsequent threshold values.

The application of a linear increasing or decreasing gradient of the bias voltage of a capacitive transducer of a microphone in the controlled way, as described above, shows a negligible impact on the bias operation point of the preamplifier of the microphone. In particular, the linear variation of the bias voltage allows improvement of the response of the amplifier of the transducer of the microphone, when the microphone bias voltage is under some voltage variation over time due to sound pressure variation. The electric circuitry to regulate the bias voltage for the transducer of the microphone enables to keep the microphone away from a collapse event and to protect the preamplifier against saturation effect.

DETAILED DESCRIPTION OF ILLUSTRATIVE EMBODIMENTS

Figure 1:
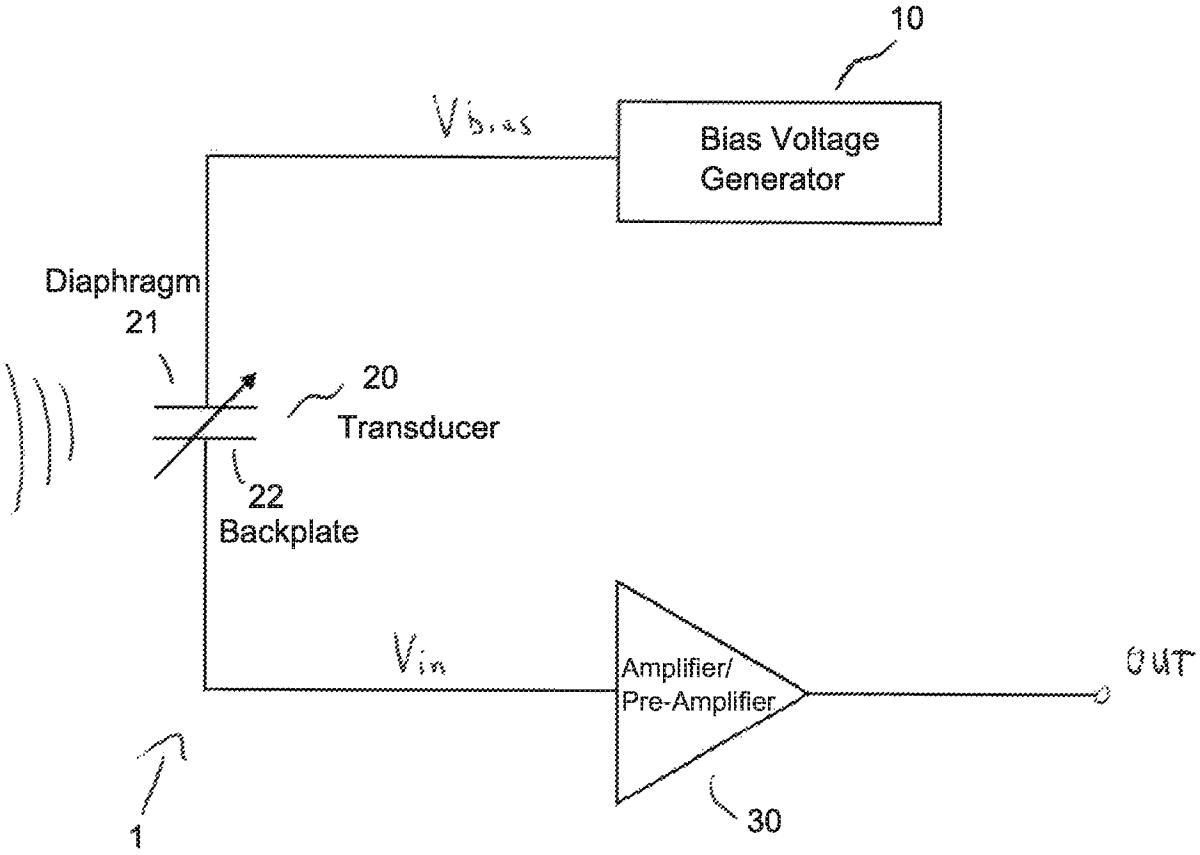
FIG. 1 shows an embodiment of a microphone comprising a bias voltage generator, a transducer and a preamplifier.

FIG. 1 shows an embodiment of a microphone 1, for example, a MEMS microphone, comprising a bias voltage generator 10 to generate a bias voltage Vbias that is provided for operating a transducer 20 of the microphone. The transducer 20 comprises a variable capacitor having a variable capacitance that changes its capacitance depending on a sound pressure that impacts on a membrane of the variable capacitor. The transducer 20 generates an input signal Vin for an amplifier/pre-amplifier 30 to generate an amplified output signal OUT. The level of the input signal Vin changes in dependence on the sound pressure exerted on the transducer 20. The variable capacitor of the transducer 20 comprises a diaphragm 21 and a backplate 22.

By an acoustical input, in particular a pressure wave, the diaphragm 21 may be deflected such that the distance between the diaphragm 21 and the backplate 22 changes, resulting in a change of the capacitance of the transducer. However, when the transducer is subjected to very high sound pressure levels, a collapse of the diaphragm may occur. The collapse may result in a contact between the diaphragm 21 and the backplate 22.

In order to delay the occurrence of an acoustical collapse of the microphone and to increase the dynamic range of the microphone, the bias voltage Vbias can be reduced before the sound pressure level gets too high. However, a reduction of the bias voltage Vbias causes the preamplifier DC input voltage to move away from its biasing operation point and potentially bring it to saturation, which will turn into a lack of sensitivity and/or distortion.

Figure 2:
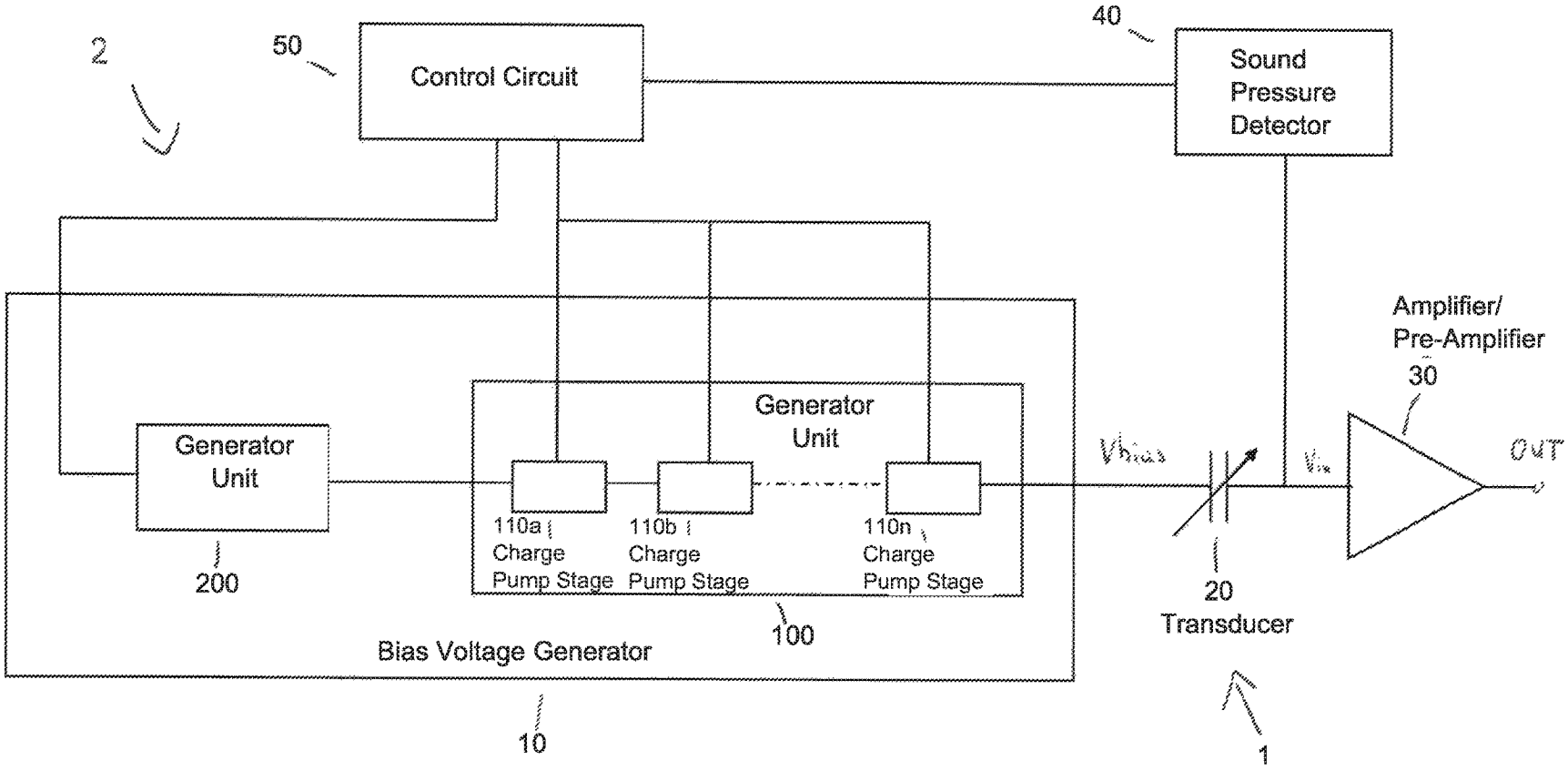
FIG. 2 shows an embodiment of an electric circuitry to regulate a bias voltage for a transducer of a microphone.

FIG. 2 shows an embodiment of an electric circuitry 2 of the microphone 1 to regulate the bias voltage Vbias for the transducer 20 of the microphone so that an acoustical collapse is prevented or at least delayed. The bias voltage Vbias is varied, i.e., reduced and increased, in a controlled way and with a negligible impact on the bias operation point of the preamplifier 30.

The electric circuitry 2 comprises a bias voltage generator 10 to generate the bias voltage Vbias for a transducer 20 of the microphone. The bias voltage generator 10 is coupled to the transducer 20 of the microphone. An input signal Vin generated by the transducer 20 and received by the amplifier 30 is amplified by the amplifier 30. The amplifier 30 generates the amplified output signal OUT in dependence on the input signal Vin of the transducer 20. The electric circuitry further comprises a sound pressure detector 40 to detect the sound pressure which impacts on the transducer 20 of the microphone. The bias voltage generator 10 is configured to generate the bias voltage Vbias with a linear increasing or decreasing gradient/slope, if the sound pressure detected by the sound pressure detector 40 exceeds or falls below at least one predefined threshold value of the sound pressure.

The electric circuitry 2 comprises a control circuit 50 to monitor the sound pressure detected by the sound pressure detector 40 and to control the bias voltage generator 10 in dependence on the sound pressure detected by the sound pressure detector 40.

The bias voltage generator 10 comprises a first generator unit 100 to generate a first bias voltage portion and a second generator unit 200 to generate a second bias voltage portion. The value of the bias voltage Vbias is dependent on the first and second bias voltage portions. The first generator unit 100 may be configured as a charge pump comprising a plurality of charge pump stages 110*a*, 110*b*, . . . , 110*n*.

The operation of the electric circuitry 1 is explained in the following with reference to FIGS. 3A, 3B, 4 and 5.

Figure 3A:
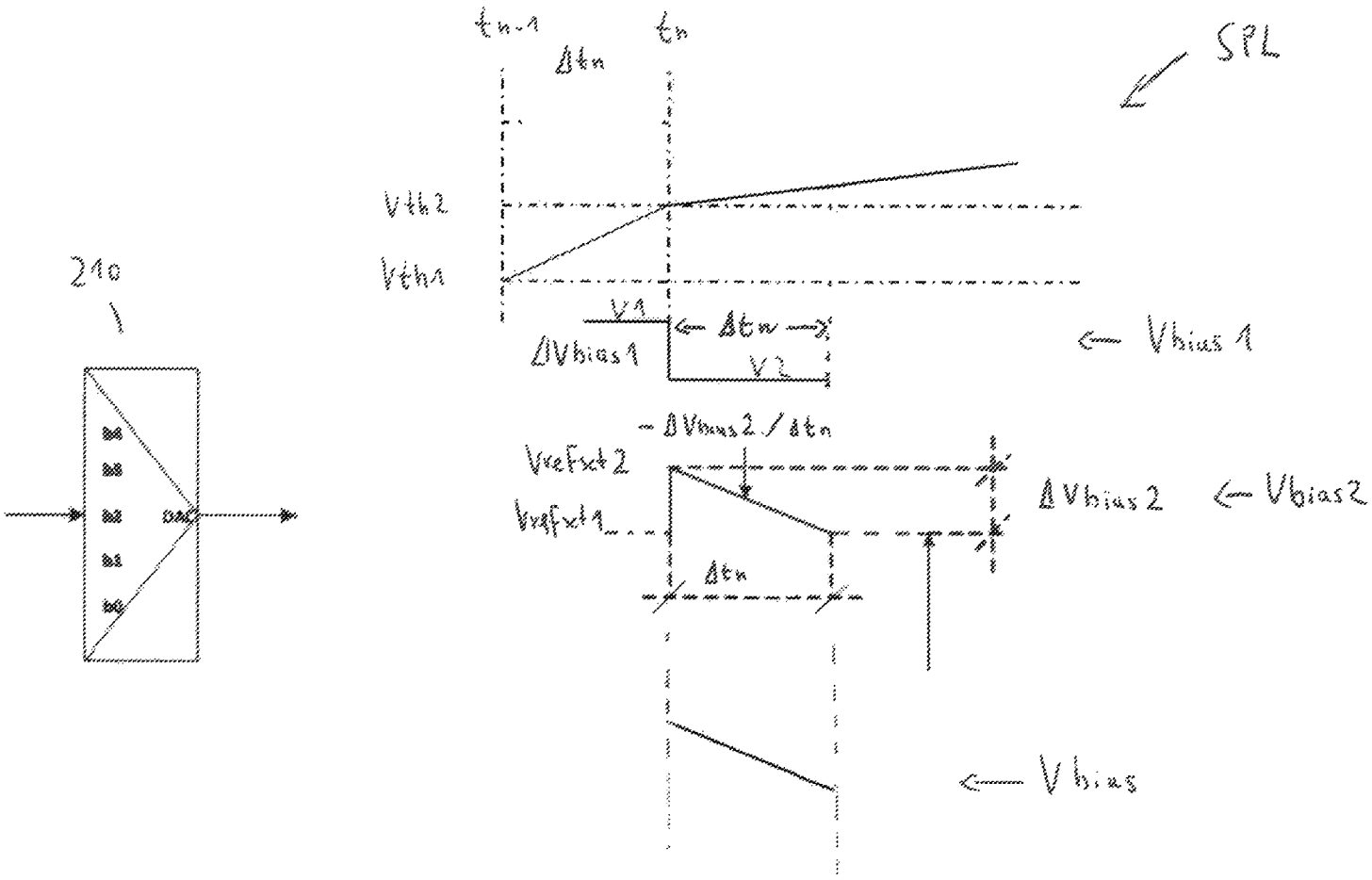
FIG. 3A shows an embodiment of a generator unit of the bias voltage generator to generate a second bias voltage portion during rising of the sound pressure level between subsequent threshold values.

FIG. 3A shows a course of the sound pressure level SPL increasing between threshold values Vth1 and Vth2. The sound pressure level increases from a time tn−1 until a time tn with a first gradient, and after the time tn with another gradient which is not considered hereinafter. The sound pressure level exceeds the threshold value Vth1 at the time tn−1 and the threshold value Vth2 at the time tn.

The control circuit 50 monitors the sound pressure level which is detected by the sound pressure detector 40. In particular, the control circuit 50 detects the time tn−1, when the sound pressure level SPL exceeds the threshold value Vth1 and further detects the time tn, when the sound pressure level SPL exceeds the threshold value Vth2. As long as the sound pressure level SPL is below the threshold value Vth2, the generator unit 100 generates the bias voltage portion Vbias 1 with a voltage level V1. At the moment, when the sound pressure level SPL exceeds the threshold value Vth2, i.e., at the time tn, the generator unit 100 generates a voltage jump ΔVbias1 so that the bias voltage portion Vbias1 is generated with a lower level V2. The lower voltage level V2 is the predefined voltage level ΔVbias1 below the voltage level V1. The voltage level V2 is generated for the time interval Δtn, i.e., the time span between the time tn−1 and tn.

The generator unit 100 generates a staircase-shaped course of the bias voltage portion Vbias1 by deactivating/disabling one of the charge pump stages 110*a*, 110*b*, . . . , 110*n* of the generator unit 100. If the control circuit 50 determines that one of the predefined threshold values is exceeded, one of the charge pump stages 110*a*, . . . , 110*n* is deactivated. The new value of the bias voltage portion is generated as a consequence of the exceeding of one of the threshold values for a time span between said one of the threshold values and a subsequent one of the threshold values. Regarding FIG. 3A, the voltage value V2 is generated as a consequence of the exceeding of the threshold value Vth1.

At the same time, when the generator unit 100 generates the voltage level V2, i.e., at the time tn, the generator unit 200 generates a voltage jump from a first, nominal voltage value Vrefset1 to a second higher voltage value Vrefset2. The generator unit 200 then reduces the bias voltage portion Vbias2 from the voltage value Vrefset2 until the nominal, first voltage value Vrefset1 is reached again. As illustrated in FIG. 3A, the voltage portion Vbias2 has a continuous decreasing course for a timespan tn. The derivative of the decreasing gradient of the bias voltage portion Vbias2 is determined by −ΔVbias2/Δtn, wherein the voltage jump ΔVbias2 is equal to the voltage jump ΔVbias1 and the timespan Δtn is the timespan between the time tn−1 and tn during which the sound pressure level SPL increases from the threshold value Vth1 to the threshold value Vth2.

The generator unit 200 is configured to generate the bias voltage portion Vbias2 with a linear decreasing gradient between the value Vrefset2 and the value Vrefset1 of the bias voltage portion Vbias2, wherein the derivative of the linear decreasing gradient is determined by the time span Δtn between the time tn−1 and the time tn, if the control circuit 50 determined the sound pressure level detected by the sound pressure detector exceeding the threshold value Vth1 at the time tn−1 and the sound pressure level exceeding the threshold value Vth2 at the time tn.

The course of the bias voltage portion Vbias2 may be generated by a digital-to-analog converter 210 of the generator unit 200. The digital-to-analog converter 210 is controlled by a control signal generated by the control circuit 50, for example, by control bits b0, . . . , b4. As illustrated in FIG. 3A, the bias voltage Vbias2 can be a fixed DC voltage that can be adjusted using, for example, four or more control bits generated by the control circuit 50.

The bias voltage generator 10 is configured to generate the bias voltage Vbias in dependence on the bias voltage portion Vbias1 and the bias voltage portion Vbias2. In particular, the bias voltage Vbias is generated by a superposition of the bias voltage portions Vbias1 and Vbias2. For example, the bias voltage generator 10 may be configured such that the bias voltage Vbias can be calculated as Vbias=Vbias1+Vbias2=Vrefset(t)+Nst×Vref, where Nst is the number of activated charge pump stages and Vref is a voltage value generated by each one of the charge pump stages 110*a*, 110*b*, . . . , 110*n*.

The bias voltage generator 10 is configured to generate the bias voltage Vbias with a linear decreasing gradient, if the control circuit 50 detects the sound pressure decreasing between the time tn−1 and the time tn. The bias voltage generator 10 is configured to generate the linear decreasing gradient of the bias voltage Vbias with a derivative, wherein the derivative depends on the timespan Δtn between the time tn−1 and the time tn. In particular, the control circuit 50 is configured to control the bias voltage generator 10 so that the bias voltage generator 10 generates the decreasing gradient of the bias voltage Vbias with a first derivative, when the control circuit 50 determines a first timespan between the time tn−1 and the time tn, and generates the decreasing gradient of the bias voltage Vbias with a second derivative being lower than the first derivative, when the control circuit 50 determines a second timespan between the time tn−1 and the time tn, wherein the second time span is larger than the first time span.

Figure 3B:
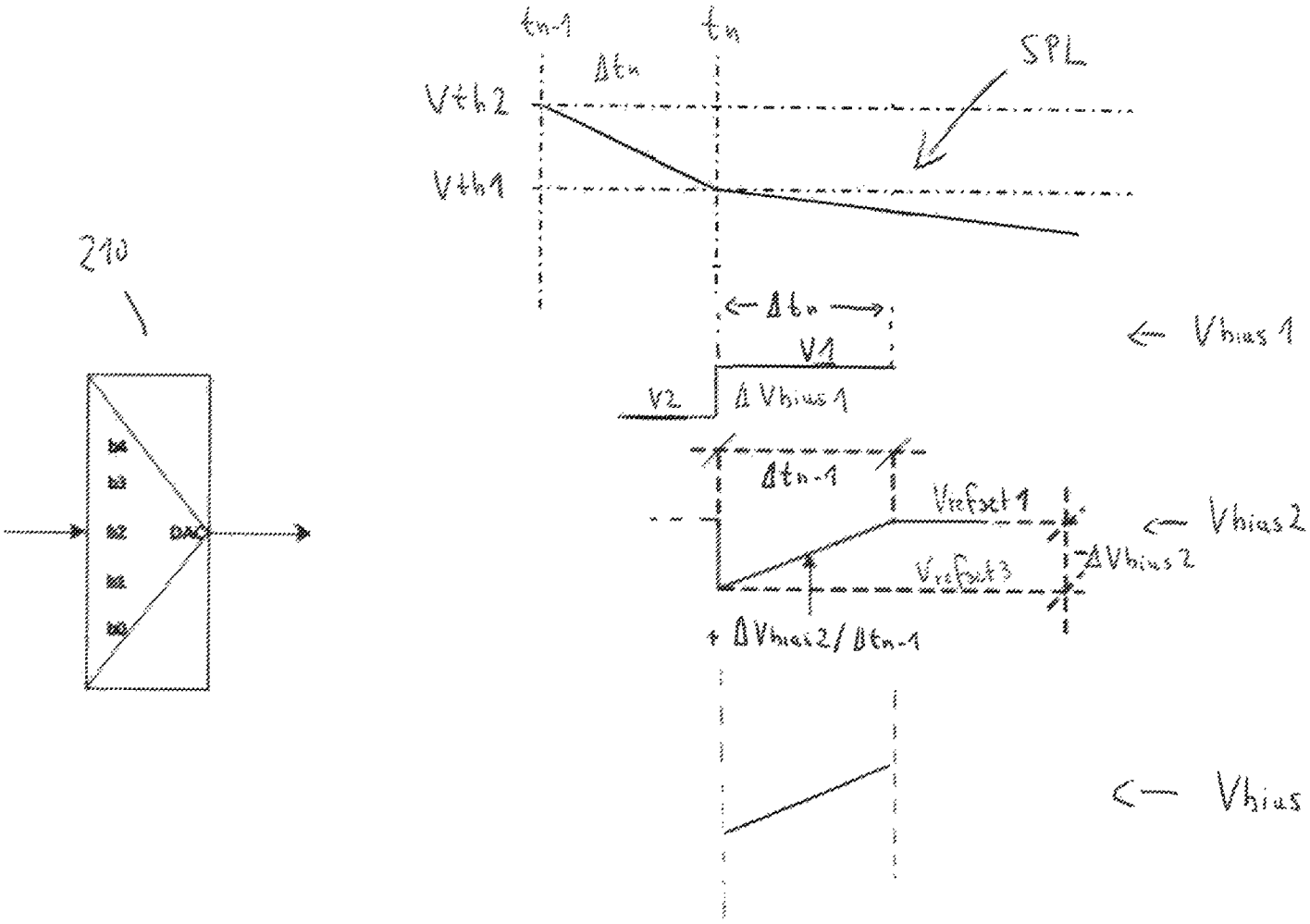
FIG. 3B shows an embodiment of a generator unit of the bias voltage generator to generate a second bias voltage portion during decreasing of the sound pressure level between subsequent threshold values.

FIG. 3B illustrates the operation of the electric circuitry 1 to regulate the bias voltage Vbias, when the sound pressure level SPL falls from the threshold value Vth2 at the time tn−1 and until the threshold value Vth1 at the time tn. The control circuit 50 monitors the course of the sound pressure level SPL detected by the sound pressure detector 40. In particular, the control circuit 50 determines the time tn−1, when the sound pressure level SPL falls below the threshold value Vth2, and the time tn, when the sound pressure level SPL falls below the threshold value Vth1.

Assuming that, during the falling period of the sound pressure level between the time tn−1 and the time tn, the generator unit 100 generates the bias voltage portion Vbias1 with a voltage value V2. When the control circuit 50 detects that the sound pressure level SPL falls below the threshold value Vth1 at the time tn, the bias voltage portion Vbias1 is increased by the voltage level ΔVbias1 to the voltage value V1. FIG. 3B illustrates the staircase-shaped course of the bias voltage portion Vbias1.

The generator unit 100 generates a rising staircase-shaped course of the bias voltage portion Vbias1 by activating/enabling one of the charge pump stages 110*a*, 110*b*, . . . , 110*n* of the generator unit 100. If the control circuit 50 determines that the sound pressure level SPL falls below one of the predefined threshold values, one of the charge pump stages 110*a*, . . . , 110*n* is activated in addition to the already activated charge pump stages. The new value of the bias voltage portion Vbias1 is generated as a consequence of the falling of the sound pressure level below one of the threshold values for a time span between said one of the threshold value and the subsequent one of the threshold values.

Regarding FIG. 3B, the voltage value V1 is generated as a consequence of the falling of the sound pressure level SPL below the threshold value Vth2. The voltage jump ΔVbias1 is generated at the moment of the sound pressure level falling below the threshold value Vth1. The new voltage level V1 is generated at least for the time duration tn between the time tn−1 and tn.

At the same time, when the control circuit 50 detects that the sound pressure SPL falls below the threshold value Vth1, i.e., when the bias voltage portion Vbias1 jumps from the voltage level V2 to the voltage value V1, the generator unit 200 generates a negative jump −ΔVbias2 of the bias voltage portion Vbias2 from the first, nominal value Vrefset1 to the lower voltage value Vrefset3. The generator unit 200 then increases the bias voltage portion Vbias2 continuously from the voltage value Vrefset3 to the voltage value Vrefset1 during the time duration Δtn. The time duration Δtn corresponds to the timespan between the time tn−1 at which the sound pressure level SPL falls below the threshold value Vth2 and the time tn at which the sound pressure level SPL falls below the threshold value Vth1.

The generator unit 200 is configured to generate the bias voltage portion Vbias2 with a linear increasing gradient between the value Vrefset3 and the value Vrefset1 of the second bias voltage portion Vbias2, wherein the derivative of the linear increasing gradient is determined by the time span tn between the time tn−1 and the time tn, if the control circuit 50 determined the sound pressure detected by the sound pressure detector falling below the second threshold value Vth2 at the time tn−1 and the sound pressure level falling below the threshold value Vth1 at the time tn.

As shown in FIG. 3B, the generator unit 200 generates a negative voltage jump −ΔVbias2 at the time tn. According to a preferred embodiment, the voltage level ΔVbias2 is equal to the voltage level ΔVbias1. The generator unit 200 generates the increasing course of the bias voltage portion Vbias2 with a derivative equal to −ΔVbias2/Δtn. The negative voltage jump −ΔVbias2 of the bias voltage portion Vbias2 can be generated by a digital-to-analog converter 210 of the generator unit 200. The voltage jump −ΔVbias2 is controlled by the control circuit 50 which generates a control signal that is applied to the generator unit 200. The control signal may comprise control bits b0, . . . , b4.

The bias voltage generator 10 generates the bias voltage Vbias by a superposition of the bias voltage portion Vbias1 and the bias voltage portion Vbias2. In particular, the bias voltage generator 10 is configured to generate the bias voltage Vbias with the linear increasing gradient, when the sound pressure decreases between the time tn−1 and the time tn, as shown in FIG. 3B. The bias voltage generator 10 is configured to generate the linear increasing gradient of the bias voltage Vbias with a derivative, wherein the derivative depends on the timespan Δtn between the time tn−1 and the time tn. The control circuit 50 is configured to control the bias voltage generator 10 so that the bias voltage generator generates the increasing gradient of the bias voltage Vbias with a first derivative, when the control circuit 50 determines a first timespan between the time tn−1 and the time tn, and generates the increasing gradient of the bias voltage Vbias with a second derivative being lower than the first derivative, when the control circuit 50 determines a second timespan between the time tn−1 and the time tn, wherein the second timespan is larger than the first timespan.

Figure 4:
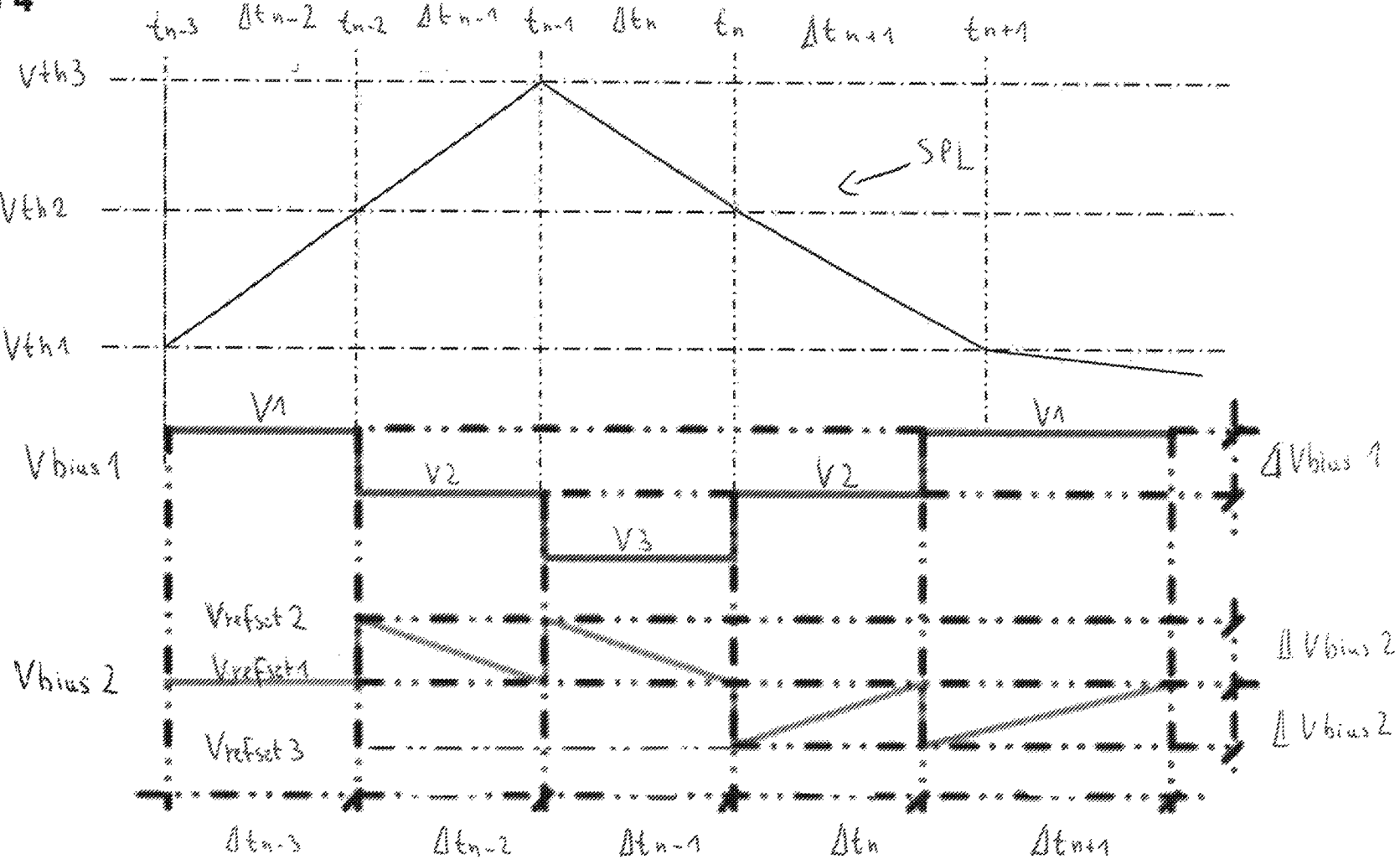
FIG. 4 illustrates a course of the first and second bias voltage portion during variation of the sound pressure level.

FIG. 4 illustrates a rising and falling portion of the sound pressure level SPL and the associated bias voltage portion Vbias1 generated by the generator unit 100 and the bias voltage portion Vbias2 generated by the generator unit 200.

The generator unit 100 is configured to generate a staircase-shaped course of the bias voltage portion Vbias1 such that a current value of the bias voltage portion is decreased by a voltage level/jump ΔVbias1, if the control circuit 50 determined that the sound pressure detected by the sound pressure detector 40 exceeded one of a plurality of threshold values Vth1, Vth2 and Vth3. The generator unit 100 is further configured to generate a staircase-shaped course of the bias voltage portion Vbias1 such that a current value of the bias voltage portion Vbias1 is increased by the voltage level/jump ΔVbias1, if the control circuit 50 determined that the sound pressure detected by the sound pressure detector 40 has fallen below one of the threshold values Vth1, Vth2 and Vth3.

As shown in FIG. 4, the generator unit 100 is configured to generate the bias voltage portion Vbias1 with a value V1, when the control circuit 50 determines the sound pressure level SPL detected by the sound pressure detector 40 being below the threshold value Vth1. The generator unit 100 is further configured to generate the bias voltage portion Vbias1 with the value V2 during a time interval, if the control circuit 50 determined the sound pressure level SPL detected by the sound pressure detector 40 being between the threshold value Vth1 and the threshold value Vth2 during a previous time interval, wherein the threshold value Vth2 is above the threshold value Vth1.

The generator unit 100 is configured to generate the bias voltage portion Vbias1 with the value V2 being by the voltage level/voltage jump ΔVbias1 below the voltage value V1, if the control circuit 50 determined the sound pressure detected by the sound pressure detector exceeding the threshold value Vth1. The generator unit 100 is further configured to generate the bias voltage portion Vbias1 with the voltage value V2 for a time span, during which the control circuit 50 determined the sound pressure level detected by the sound pressure detector being between the threshold value Vth1 and the threshold value Vth2.

In particular, the voltage jump from the voltage value V1 to the voltage value V2 is generated, if it is determined from the control circuit 50 that the sound pressure level SPL exceeded the threshold value Vth1. However, the negative voltage jump −ΔVbias1 from the voltage value V1 to the voltage value V2 is generated with a delay, i.e., not at the time tn−3, but at the time tn−2, when the sound pressure level exceeds the threshold value Vth2. The voltage level V2 is then generated for the time duration Δtn−2, i.e., the time span between the time tn−3 and the time tn−2.

As illustrated in FIG. 4, the generator unit 100 generates the bias voltage portion Vbias1 with the value V1, when the sound pressure level increases between the threshold value Vth1 and the threshold value Vth2. In order to generate the voltage value V1, all charge pump stages 110*a*, 110*b*, . . . , 110*n* are activated. At the moment tn−2, when the sound pressure level exceeds the threshold value Vth2, one of the charge pump stages 110*a*, 110*b*, . . . , 110*n* of the generator unit 200 is deactivated so that the bias voltage portion Vbias1 shows the negative voltage jump −ΔVbias1.

At the end of the time duration Δtn−2 after the time tn−2, the generator unit 100 generates again a negative voltage jump −ΔVbias1 of the bias voltage portion Vbias1 from the value V2 to the value V3. The voltage jump to the voltage value V3 is generated, because the control circuit 50 has detected that the sound pressure level SPL exceeded the threshold value Vth2 at the time tn−2. The voltage value V3 is kept constant for a time duration Δtn−1 which corresponds to the timespan between the time tn−2 and the time tn−1.

At the end of the time span Δtn−1 after the time tn−1, the generator unit 100 generates a positive voltage jump ΔVbias1 of the bias voltage portion Vbias1 from the value V3 to the value V2, because the control circuit 50 has detected that the sound pressure level SPL has fallen below the threshold value Vth3 at the time tn−1. The voltage value V2 is now kept constant from the time tn for a time duration Δtn which corresponds to the timespan between the time tn−1 and the time tn.

At the end of the time duration Δtn after the time tn the generator unit 100 again generates a positive voltage jump +ΔVbias1 from the voltage value V2 to the value V1, because the control circuit 50 detected that the sound pressure level has fallen below the threshold value Vth2 at the time tn. In particular, the generator unit 100 is configured to generate the bias voltage portion Vbias1 with the value V1 being by the voltage jump ΔVbias1 above the second value V2, if the control circuit 50 determined the sound pressure detected by the sound pressure detector falling below the threshold value Vth2. The generator unit 100 is further configured to generate the bias voltage portion Vbias1 with the value V1 at least for a time span, during which the control circuit 50 determined the sound pressure level detected by the sound pressure detector being between the threshold value Vth2 and the threshold value Vth1.

FIG. 4 further shows the course of the bias voltage portion Vbias2 generated from the generator unit 200. Whenever the generator unit 100 generates a negative voltage jump −ΔVbias1, the generator unit 200 generates a positive voltage jump +ΔVbias2 from the (nominal) value Vrefset1 to the value Vrefset2. The bias voltage portion Vbias2 is then decreased during the time interval at which the bias voltage portion Vbias1 is kept constant from the value Vrefset2 to the value Vrefset1. On the other hand, whenever the bias voltage portion Vbias1 has a positive voltage jump +ΔVbias1, the generator unit 200 generates a negative voltage jump −ΔVbias2. The bias voltage portion Vbias2 is then increased during the time duration during which the bias voltage portion Vbias1 is kept constant from the value Vresfset3 to the value Vrefset1.

The generator unit 200 is configured to generate the (nominal) value Vrefset1 of the bias voltage portion Vbias2, if the control circuit 50 determines the sound pressure level detected by the sound pressure detector 40 being below the threshold value Vth1. The generator unit 200 is further configured to increase the value Vrefset1 of the bias voltage portion Vbias2 by the voltage jump +ΔVbias to a value Vrefset2, if the control circuit 50 determined the sound pressure level exceeding one of the threshold values. The generator unit 200 is configured to decrease the value Vrefset2 until the value Vrefset1 is reached.

Furthermore, the generator unit 200 is configured to decrease the value Vrefset1 of the bias voltage portion Vbias2 by the voltage jump −ΔVbias2 to the value Vrefset3 of the bias voltage portion Vbias2, if the control circuit 50 determined the sound pressure level falling below the one of the threshold values. Furthermore, the generator unit 200 is configured to increase the value Vrefset3 until the value Vrefset1 is reached. It has to be noted that, according to a preferred embodiment, the amount of the voltage jump ΔVbias2 is equal to the amount of the voltage jump ΔVbias1.

Figure 5:
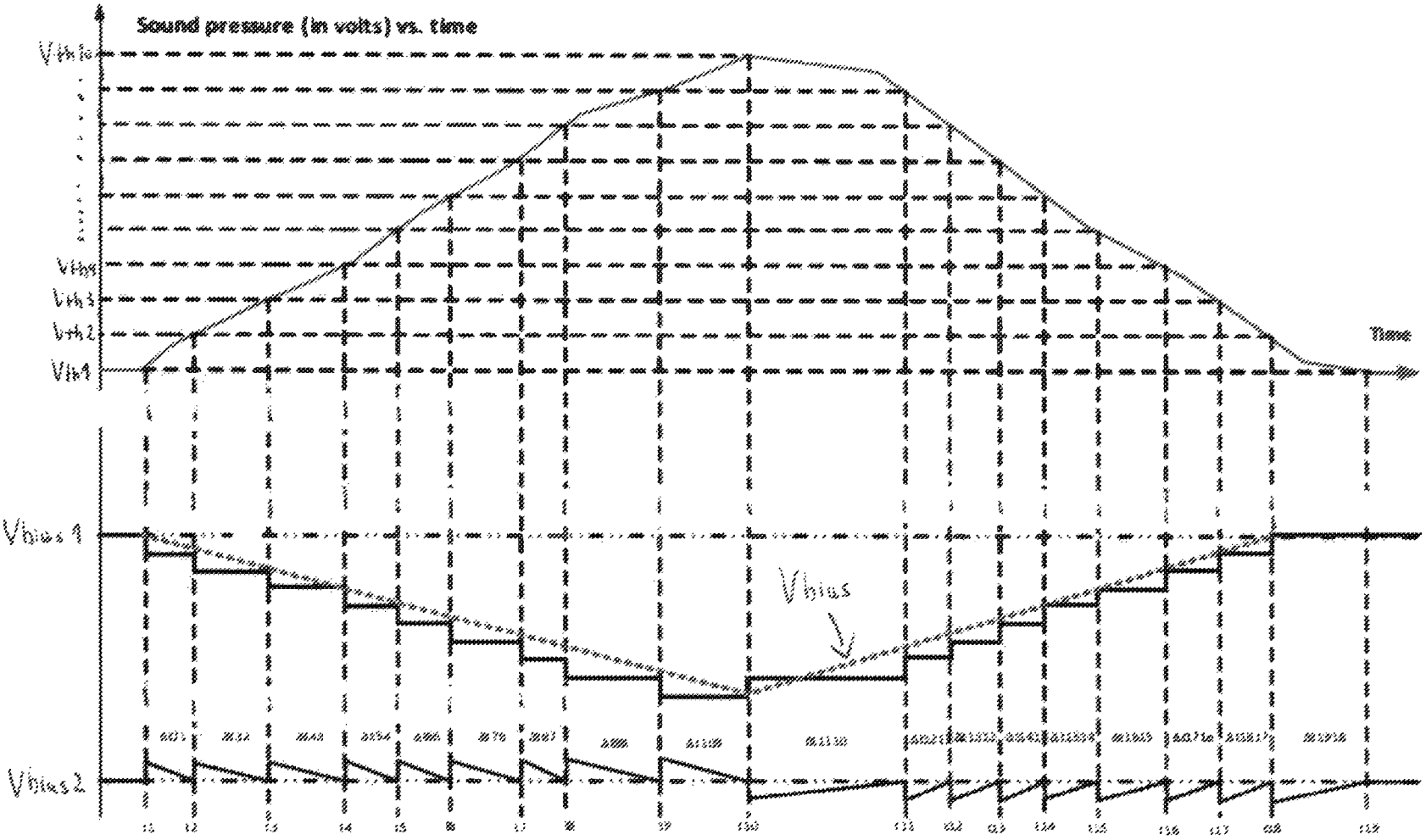
FIG. 5 illustrates a variation of the sound pressure between a plurality of threshold values and the associated first and second bias voltage portions generated by the bias voltage generator.

FIG. 5 illustrates a course of a sound pressure increasing between threshold values Vth1, . . . , Vth10 and then decreasing again from the threshold value Vth10 below the threshold value Vth1. FIG. 5 further shows the course of the bias voltage portion Vbias1 generated by the generator unit 100 and the course of the bias voltage portion Vbias2 generated by the generator unit 200.

FIG. 5 illustrates that the time interval/duration during which the level of the bias voltage portion Vbias1 is kept constant is determined by the timespan between subsequent times at which threshold values Vth1, . . . , Vth10 are exceeded or are gone below. Furthermore, FIG. 5 illustrates that the derivative of the increasing or decreasing course of the bias voltage portion Vbias2 also depends on the timespan between subsequent threshold values.

It is noted that FIG. 5 is a simplified illustration in which the course of the bias voltage portion Vbias1 and the course of the bias voltage portion Vbias2 is shown in synchronization with the course of the sound pressure level SPL. Actually, the bias voltage portion Vbias1 and the bias voltage portion Vbias2 are delayed by the first time interval Δt21 between the time t1 and t2. That means that the course of the bias voltage portion Vbias1 and the course of the bias voltage portion Vbias2 has shifted to the right by the time interval Δt21.

The bias voltage Vbias which is a superposition of the bias voltage portions Vbias1 and Vbias2 shows a linear decreasing or increasing course. The decrease and the increase of the bias voltage Vbias done with the electric circuitry 2 of FIG. 2 leads to a much reduced total harmonic distortion at the preamplifier 30. The described method can be extended to a situation where the bias voltage portion Vbias1 is reduced by a voltage amount of more than one charge pump stage at the time and the bias voltage portion Vbias2 is used to compensate this accordingly.

What is claimed is:

1. An electric circuit for regulating a bias voltage for a transducer of a microphone, the electric circuit comprising:

a bias voltage generator configured to generate the bias voltage for the transducer of the microphone;

a sound pressure detector configured to detect sound pressure which impacts the transducer of the microphone; and a control circuit configured to monitor the sound pressure detected by the sound pressure detector and to control the bias voltage generator according to the sound pressure detected by the sound pressure detector;

wherein the bias voltage generator is configured to generate the bias voltage with a linear increasing gradient or linear decreasing gradient in response to the sound pressure detected by the sound pressure detector exceeding or falling below at least one threshold value of the sound pressure;

wherein the bias voltage generator is configured to generate the bias voltage with the linear decreasing gradient in response to the sound pressure detected by the sound pressure detector increasing between a first time and a second time that is after the first time;

wherein the bias voltage generator is configured to generate the bias voltage with the linear increasing gradient in response to the sound pressure detected by the sound pressure detector decreasing between the first time and the second time;

wherein the bias voltage generator is configured to generate the linear increasing gradient or linear decreasing gradient of the bias voltage according to a derivative, wherein the derivative depends on a time span between the first time and the second time;

wherein the control circuit is configured to control the bias voltage generator so that the bias voltage generator generates the linear increasing gradient or the linear decreasing gradient of the bias voltage according to a first derivative in response to the control circuit determining a first time span between a first time and a second time; and wherein the control circuit is further configured to control the bias voltage generator so that the bias voltage generator generates the linear increasing gradient or the linear decreasing gradient of the bias voltage according to a second derivative that is lower than the first derivative and in response to the control circuit determining a second time span between the first time and the second time, wherein the second time span is larger than the first time span.

2. The electric circuit of claim 1, wherein the bias voltage generator comprises:

a first generator unit configured to generate a first bias voltage portion; and a second generator unit configured to generate a second bias voltage portion;

wherein the value of the bias voltage is dependent on the first bias voltage portion and the second bias voltage portion.

3. The electric circuit of claim 2, wherein the first generator unit is configured to generate a staircase-shaped course of the first bias voltage portion such that a current value of the first bias voltage portion is decreased by a voltage jump in response to the control circuit determining that the sound pressure detected by the sound pressure detector exceeds one of a plurality of threshold values, and further such that the current value of the first bias voltage portion is increased by the voltage jump in response to the control circuit determining the sound pressure detected by the sound pressure detector falls below a threshold value of the plurality of threshold values.

4. The electric circuit of claim 2, wherein the first generator unit is configured to generate the first bias voltage portion with a first value in response to the control circuit determining that the sound pressure detected by the sound pressure detector is below a first threshold value of a plurality of threshold values.

5. The electric circuit of claim 4, wherein the first generator unit is configured to generate the first bias voltage portion with a second value during a time interval in response to the control circuit determining that a sound pressure level detected by the sound pressure detector is between the first threshold value and a second threshold value of the plurality of threshold values during a previous time interval, wherein the second threshold value is above the first threshold value.

6. The electric circuit of claim 5 wherein the first generator unit is configured to generate the first bias voltage portion with the second value being below the first value by a voltage jump below the first value in response to the control circuit determining that the sound pressure detected by the sound pressure detector exceeds the first threshold value; and wherein the first generator unit is configured to generate the first bias voltage portion with the second value for a time span during which the control circuit determines that the sound pressure detected by the sound pressure detector is between the first threshold value and the second threshold value.

7. The electric circuit of claim 5, wherein the first generator unit is configured to generate the first bias voltage portion with the first value being above the second value by a first voltage jump in response to the control circuit determining that the sound pressure detected by the sound pressure detector falls below the second threshold value; and wherein the first generator unit is configured to generate the first bias voltage portion with the first value for at least a time span during which the control circuit determines that the sound pressure detected by the sound pressure detector is between the first threshold value and the second threshold value.

8. The electric circuit of claim 5 wherein the second generator unit is configured to generate a first value of the second bias voltage portion in response to the control circuit determining that the sound pressure detected by the sound pressure detector is below the first threshold value;

wherein the second generator unit is configured to increase the first value of the second bias voltage portion by a second voltage jump to a second value of the second bias voltage in response to the control circuit determining that the sound pressure detected by the sound pressure detector exceeds the first threshold value; and wherein the second generator unit is configured to decrease the first value of the second bias voltage portion by the second voltage jump to a third value of the second bias voltage portion in response to the control circuit determining that the sound pressure detected by the sound pressure detector falls below the second threshold value.

9. The electric circuit of claim 8, wherein the second generator unit is configured to decrease the second value of the second bias voltage portion until the first value of the second bias voltage portion is reached; and wherein the second generator unit is configured to increase the third value of the second bias voltage portion until the first value of the second bias voltage portion is reached.

10. The electric circuit of claim 8, wherein the amount of the second voltage jump is equal to the amount of a first voltage jump generated by the first generator unit as a part of the first bias voltage portion with the first value being above the second value by the first voltage jump in response to the control circuit determining that the sound pressure detected by the sound pressure detector falling below the second threshold value.

11. The electric circuit of claim 8, wherein the second generator unit is configured to generate the second bias voltage portion with the linear decreasing gradient between the second value of the second bias voltage portion and the first value of the second bias voltage portion, wherein a derivative of the linear decreasing gradient is determined according to a time span between a first time and a second time and in response to the control circuit determining that the sound pressure detected by the sound pressure detector exceeds the first threshold value at the first time and that the sound pressure exceeds the second threshold value at the second time; and wherein the second generator unit is configured to generate the second bias voltage portion with the linear increasing gradient between the third value of the second bias voltage portion and the first value of the second bias voltage portion, wherein a derivative of the linear increasing gradient is determined according to the time span between the first time and the second time and in response to the control circuit determining that the sound pressure detected by the sound pressure detector falls below the second threshold value at the first time and that the sound pressure falls below the first threshold value at the second time.

* * * * *